US006655500B2

(12) United States Patent
Orrman et al.

(10) Patent No.: US 6,655,500 B2
(45) Date of Patent: Dec. 2, 2003

(54) TRACTION SHEAVE ELEVATOR

(75) Inventors: Jaakko Orrman, Helsinki (FI); Jorma Mustalahti, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/915,474

(22) Filed: Jul. 27, 2001

(65) Prior Publication Data

US 2002/0017434 A1 Feb. 14, 2002

Related U.S. Application Data

(63) Continuation of application No. PCT/FI00/00049, filed on Jan. 25, 2000.

(30) Foreign Application Priority Data

Jan. 27, 1999 (FI) ..... 990152
Oct. 1, 1999 (EP) ..... 99119565

(51) Int. Cl.[7] ..... B66B 11/08

(52) U.S. Cl. ..... 187/254; 187/266; 187/406

(58) Field of Search ..... 187/254, 266, 187/404, 406, 411

(56) References Cited

U.S. PATENT DOCUMENTS 5,899,300 A * 5/1999 Miller et al. ..... 187/256

FOREIGN PATENT DOCUMENTS

| | | | |
|---|---|---|---|
| EP | A20631967 | | 1/1995 |
| EP | 749930 | * | 12/1996 |
| EP | A10849209 | | 6/1998 |
| EP | A20953538 | | 11/1999 |
| JP | 69178 | * | 1/1994 |
| JP | 9156855 | * | 6/1997 |
| WO | 97/11020 | * | 3/1997 |

* cited by examiner

*Primary Examiner*—Steven A. Bratlie
(74) *Attorney, Agent, or Firm*—Birch, Stewart, Kolasch & Birch, LLP

(57) ABSTRACT

In a traction sheave elevator, the elevator car is suspended on hoisting ropes by a diverting pulley. The diverting pulley used to suspend the elevator car on the hoisting ropes is mounted on one side of the elevator car.

46 Claims, 2 Drawing Sheets

TRACTION SHEAVE ELEVATOR

This is a continuation of application No. PCT/FI00/00049, filed Jan. 25, 2000.

BACKGROUND OF THE INVENTION

1. Field of the Invention

The present invention relates to a traction sheave elevator.

2. Description of the Background Art

In prior art, specification EP 0 631 967 A2 presents a traction sheave elevator without machine room, in which an elevator car moving in an elevator shaft is guided by vertical car guide rails while the counterweight moves along guide rails placed on the same side of the elevator car as the car guide rails. Such a suspension arrangement, in which all guide rails are placed as a compact structure on one side of the elevator car, is called piggyback suspension. The drive motor, provided with a traction sheave, is mounted in the upper part of the guide rails. Connected to the elevator car are two car rope pulleys, placed under the bottom of the elevator car at opposite edges. The first end of the rope is attached to a fixed top structure in the upper part of the elevator shaft, on the same side of the elevator car as where the car and counterweight guide rails are located. From the anchorage of its first end, the rope is passed down via a counterweight rope pulley attached to the counterweight, from where it is deflected up and passed to the traction sheave of the drive motor, from where it is further deflected down and passed around two rope pulleys mounted on the elevator car, so that the rope passes under the elevator car by one side, where the guide rails are located, to the other side and further up to a fixed top structure, to which the other end of the rope is fixed and which is located on the other side of the elevator car relative to the location of the car and counterweight guide rails. In this way, an advantageous 2:1 suspension arrangement is achieved, allowing the machinery to be designed in accordance with a lower torque requirement.

A problem with the prior-art elevator is that the two rope pulleys below the elevator car require a certain space in the vertical direction of the elevator. This a problem particularly in buildings where it is not possible to extend the elevator shaft substantially below the level of the lowest floor to provide a sufficient space for the rope pulleys under the elevator car when the car is at the bottom floor. This problem is often encountered in conjunction with the modernization of old elevator shafts where a scanty space has been provided at the bottom end of the shaft. In old buildings, building a new elevator shaft or extending the old one to a level clearly below the bottom floor is a significant cost factor. Similarly, an insufficient head room at the top end may be an obstacle to mounting car rope pulleys on the top of the elevator car. As for new buildings, an elevator shaft that takes up as little space in the vertical direction as possible would be an advantage.

A further problem with the prior-art elevator is that, on the opposite side of the elevator car relative to the side on which the car and counterweight guide rails are located, a sufficient space for rope passage must be provided between the shaft wall and the wall of the elevator car, which constitutes a limitation of the widthwise dimension of the elevator car, preventing effective utilization of the cross-sectional area of the elevator shaft.

SUMMARY OF THE INVENTION

The object of the invention is to eliminate the problems mentioned above.

A specific object of the invention is to disclose an elevator that is as compact as possible, requiring as little space as possible in the elevator shaft in both vertical and horizontal directions so as to allow as efficient shaft space utilization as possible. A further object of the invention is to disclose an elevator which is well suited for use both in new buildings and in old buildings for the modernization of elevator solutions in existing elevator shafts or even as an elevator for which a shaft is built afterwards in an existing building.

The elevator of the invention comprises car guide rails disposed vertically in an elevator shaft; an elevator car designed to move along the car guide rails; counterweight guide rails disposed in the elevator shaft on the same side of the elevator car as the car guide rails; a counterweight designed to move along the counterweight guide rails; an upper rope pulley mounted on a fixed top structure in the upper part of the elevator shaft; a car rope pulley connected to the elevator car; a counterweight rope pulley connected to the counterweight; a drive motor disposed in the elevator shaft to drive one of the rope pulleys; and a rope whose first end is attached to a fixed top structure in the upper part of the elevator shaft on the same side of the elevator car with the car and counterweight guide rails, from where the rope is passed via the counterweight rope pulley, upper rope pulley and car rope pulley, and whose second end is attached to a fixed top structure.

According to the invention, the second end of the rope is attached to a fixed top structure on the same side of the elevator car as the first end. The car rope pulley is rotatably mounted with bearings at the side of the elevator car on the same side of the elevator car as the car and counterweight guide rails.

'Fixed top structure' refers to a fixed structure in the upper part of the elevator shaft near the ceiling, or to the top of the elevator shaft, the guide rails in the upper part of the shaft or corresponding structures.

The invention has the advantage that it makes it possible to build an elevator that is as compact as possible in the vertical direction and, on the other hand, as large as possible in relation to the cross-sectional area of the elevator shaft. The entire machinery as well as the rope and rope pulleys can be located on one side of the elevator car as a compact package. Furthermore, the invention has the advantage that, in addition to new buildings, it is suited for use in modernization projects. A further advantage is that the space at the bottom end of the elevator shaft can be constructed to dimensions as small as possible. In addition, the invention has the advantage that it is suited for use as an elevator without machine room, with the elevator machine mounted in the elevator shaft.

In an embodiment of the elevator, the car guide rails and counterweight guide rails are attached to each other and to the wall of the elevator shaft, arranged side by side parallel to each other, the counterweight guide rails being placed between the wall of the elevator shaft and the car guide rails.

In an embodiment of the elevator, the distance between the counterweight guide rails is equal to the distance between the car guide rails. The conventional design of the counterweight is such that the mass of the counterweight equals the car weight when the car is empty, added by half the specified load. By disposing the counterweight guide rails at a maximal distance from each other, the width of the counterweight can be maximized, and consequently a compact counterweight with a short vertical dimension is achieved.

In an embodiment of the elevator, the upper rope pulley is the drive wheel connected to the drive motor. In this case, the drive motor is mounted on the car guide rails and/or counterweight guide rails in the upper part of the elevator shaft, which means that the elevator has no machine room. It is also possible to use one of the other rope pulleys mentioned as a drive wheel.

In an embodiment of the elevator, the elevator comprises an L-shaped frame structure attached to the car, extending on the side wall of the elevator car on that side where the car guide rails and counterweight guide rails are located and under the bottom of the elevator car. The car rope pulley and the guide elements acting together with the car guide rails are connected to this frame structure.

In an embodiment of the elevator, the car rope pulley is placed in the lower part of the elevator car near its bottom.

The car rope pulley is preferably disposed inside the space defined by the elevator car and the frame structure to achieve compact space utilization.

In an embodiment of the elevator, a vertical tangent to the upper rope pulley is substantially aligned with a vertical tangent to the counterweight rope pulley, in which case the rope portion between them is substantially vertical. Correspondingly, a vertical tangent to the upper rope pulley is substantially aligned with a vertical tangent to the car rope pulley, so the rope portion between these pulleys, too, is substantially vertical.

In an embodiment of the elevator, the middle plane of rotation of the counterweight rope pulley is parallel to the middle plane of rotation of the car rope pulley. The middle plane of rotation of the upper rope pulley is at an angle to the middle planes of rotation of the car rope pulley and counterweight rope pulley. In this case, the middle plane of rotation of the car rope pulley may be parallel to the side wall of the elevator car, or alternatively the middle plane of rotation of the car rope pulley may be at an angle to the side wall of the elevator car.

In an embodiment of the elevator, the drive motor is a permanent magnet synchronous motor and the upper rope pulley is integrated with the rotor of the motor.

In a traction sheave elevator without machine room, the use of a diverting pulley mounted on the side of the elevator car to suspend the car on the hoisting ropes allows the elevator to be installed in an elevator shaft having a height dimension smaller than the conventional height. In principle, this solution can be used both in elevators with machine room above and in elevators with machine room below. To economize on the cross-sectional area of the elevator shaft, the diverting pulley attached to the elevator car must be parallel to the car wall or only moderately askew relative to the wall. An economical solution is to mount the hoisting machine on a fixed structure of the elevator shaft. However, in elevators with machine room below, the amount of material including diverting pulleys and ropes is larger and, as the number of diverting pulleys and rope portions between rope pulleys is larger, a solution with machine room below may result in an elevator having a slightly larger height dimension than an elevator with machine room above. When the suspension of the elevator is implemented using a diverting pulley on the side of the elevator car, the height dimension can be best reduced by placing the drive machine at such a height in the elevator shaft that the elevator car can move to a position alongside the machine.

BRIEF DESCRIPTION OF THE DRAWINGS

In the following, the invention will be described in detail by the aid of a few examples of its embodiments with reference to the attached drawing, wherein.

DETAILED DESCRIPTION OF THE PREFERRED EMBODIMENT

Figure 1:
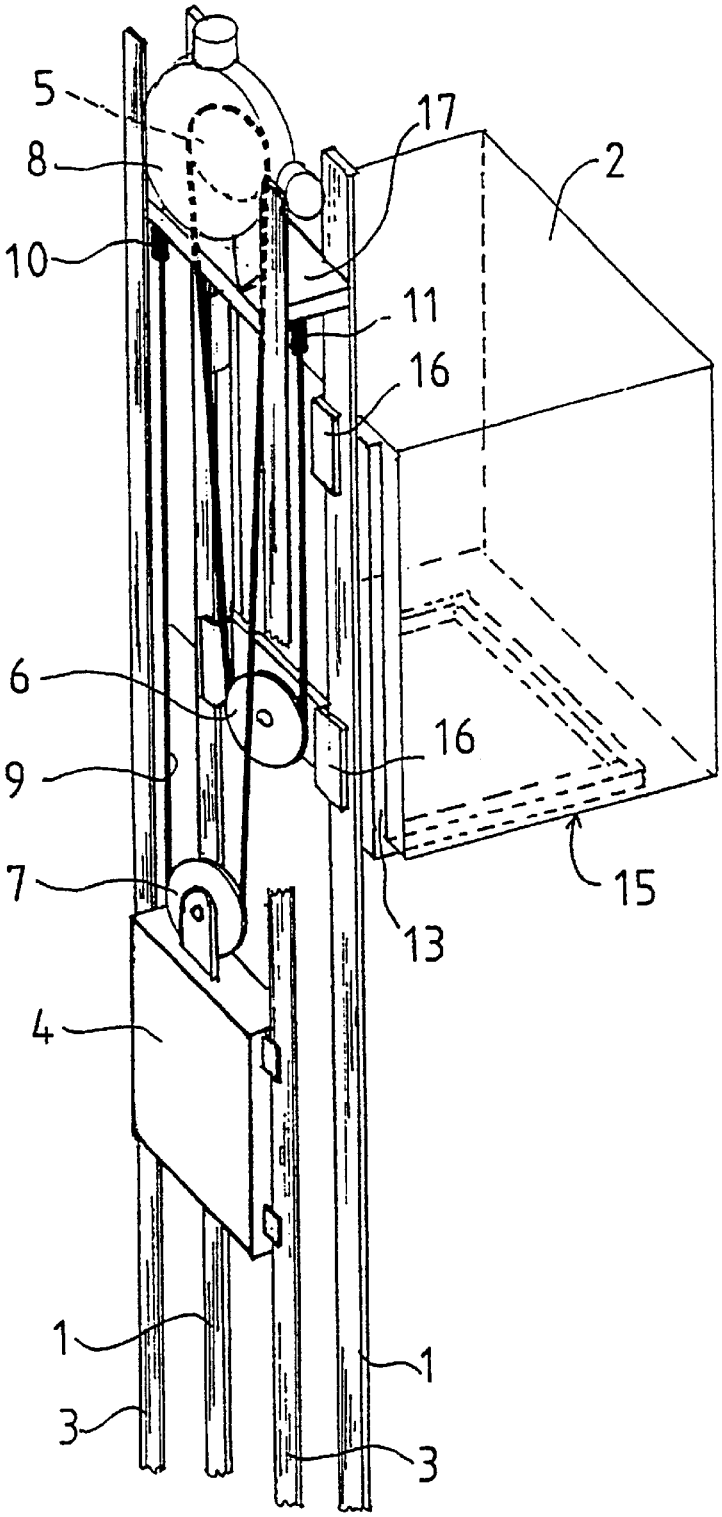
FIG. 1 presents diagram representing an embodiment of the elevator of the invention as seen in an oblique top view.

FIG. 1 presents a diagrammatic view of a traction sheave elevator with a car suspended according to the so-called piggyback principle. The car guide rails 1 are disposed vertically in the elevator shaft on one side relative to the elevator car and the elevator car 2 has been arranged to move along car guide rails 1. The counterweight guide rails 3 are disposed in the elevator shaft on the same side of the elevator car as the car guide rails 1. The car guide rails 1 and the counterweight guide rails 3 are attached to each other and to a wall 12 (not shown in FIG. 1, see FIG. 2) of the elevator shaft, mounted side by side close to each other in parallel directions so that the counterweight guide rails 3 are located between the car guide rails 1 and the wall 12 of the elevator shaft. The distance of the counterweight guide rails 3 from each other is equal to the distance of the car guide rails 1 from each other, so the counterweight 4 moving along the counterweight guide rails can be of a shape having a large width and a small length.

The drive motor 8 is mounted on a transverse support 17 connected to the upper ends of all four guide rails 1, 3. The drive motor 8 is a permanent magnet synchronous motor, the driving rope pulley 5 being integrated with its rotor.

Attached to the elevator car 2 is an L-shaped frame structure 13 extending along the side wall 14 of the elevator car 1 on that side where the car guide rails 1 and counterweight guide rails 3 are located and under the bottom 15 of the elevator car to support the car. Guide elements 16 acting together with the car guide rails 1 are connected to the frame structure 13. Connected to the frame structure 13 is also a car rope pulley 6. The car rope pulley 6 is located at the side of the elevator car 2 in its lower part on the same side of the elevator car 1 with the car guide rails 1 and counterweight guide rails 3 so that the car rope pulley 6 does not protrude below the car 1 or outside the frame structure 13.

The first end 10 of the rope 9 is attached to the support 17 between the guide rails 1, 3, from where it is passed down to the counterweight rope pulley 7 on the upper edge of the counterweight 4. From here, the rope is deflected back up and goes to the traction sheave 5 of the drive motor 8, from where it is again deflected downward and passed to the rope pulley 6 mounted on the side of the elevator car 2, from where it is deflected upward and passed to the anchorage of the second end 11 in the support 17 between the guide rails 1, 3. Thus, the elevator car is suspended on the rope loop between the traction sheave 5 and the rope end 11. All the rope pulleys 6, 7 and traction sheave 5 are located on the same side relative to the elevator car, so the rope 9 can run substantially entirely in the space between the guide rails 1, 3.

For the sake of clarity, FIG. 1 shows only one rope, but it is obvious that the rope may comprise a bundle of ropes or a plurality of adjacent ropes, as is usually the case in elevators. Also, the rope pulleys 6, 7 and traction sheave 5 are presented as simple grooved wheels, but it is obvious that when a plurality of adjacent ropes are used, the rope pulleys are manifold or several rope pulleys may be placed side by side. The rope pulleys 6, 7 may be provided with grooves of a semi-circular cross-section, and the traction sheave 5 may have undercut grooves to increase friction.

Figure 2:
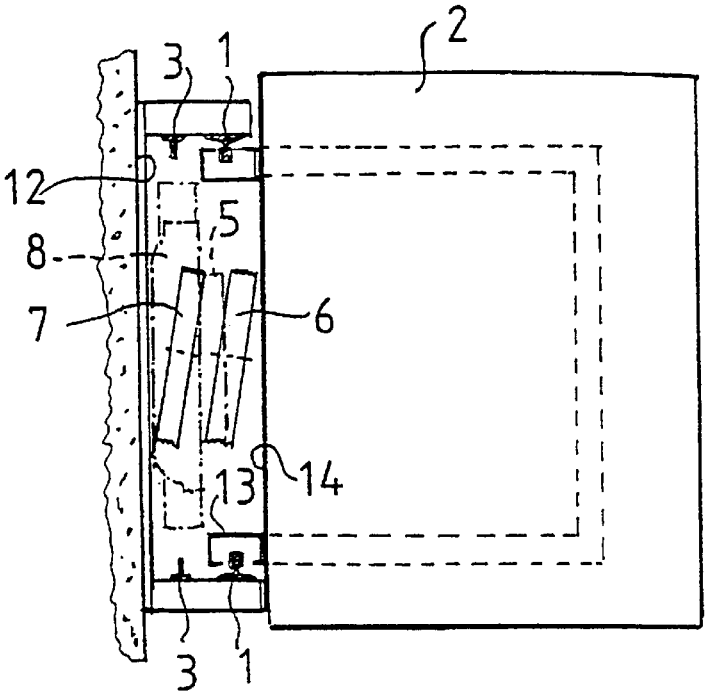
FIG. 2 presents a diagrammatic top view of the elevator in FIG. 1, and FIG. 3 a diagrammatic top view of another embodiment of the elevator of the invention.
Figure 3:
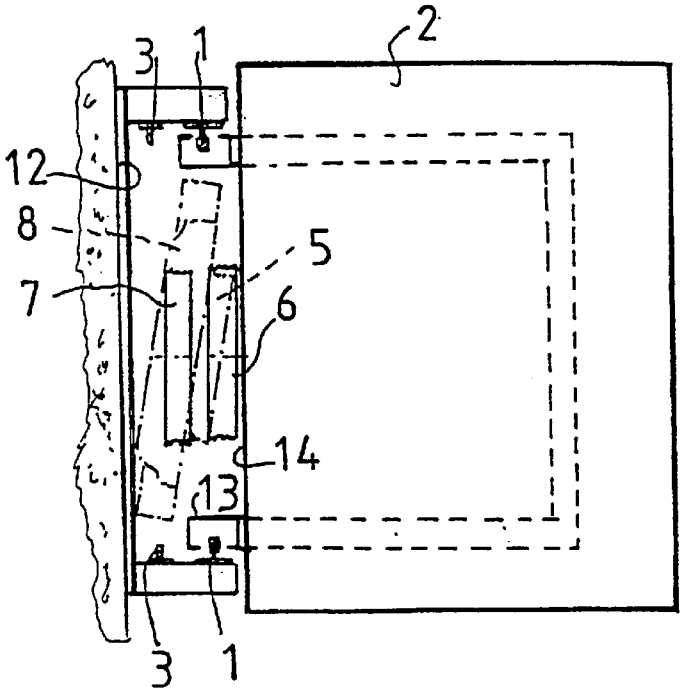

FIGS. 2 and 3 illustrate two embodiments for the arrangement of the rope pulleys 6, 7 and traction sheave 5 relative to each other. In the drawings, the drive motor 8 and the traction sheave 5 are depicted with broken lines while the counterweight rope pulley 7 and the car rope pulley 6 are depicted with solid lines. In both embodiments, the aim has been to arrange the rope pulleys 6, 7 and traction sheave 5 in such a way that the rope will apply as little skewed pull to the rope wheel grooves as possible as it passes from one wheel rim to the next. Without the arrangement described below, skewed pull might occur when the counterweight rope pulley 7 is in a high position close to the traction sheave 5 and similarly when the car rope pulley 6 is close to the traction sheave 5.

In FIGS. 2 and 3, skewed pull is eliminated by using an arrangement in which a vertical tangent to the traction sheave 5 is substantially aligned with a vertical tangent to the counterweight rope pulley 7, the rope portion between the traction sheave 5 and the counterweight rope pulley 7 being substantially vertical, and in which a tangent to the traction sheave 5 is substantially aligned with a vertical tangent to the car rope pulley 6, the rope portion 9 between the traction sheave 5 and the car rope pulley 6 being likewise substantially vertical.

In FIG. 2, both the car rope pulley 6 and the counterweight rope pulley 7 are disposed in identical positions so that their middle planes of rotation are parallel to each other and at an angle to the middle plane of rotation of the traction sheave 5. The middle plane of rotation of the traction sheave 5 is parallel to the side wall 14 of the elevator car and the shaft wall, whereas the middle planes of rotation of the car rope pulley 6 and counterweight rope pulley 7 are at an inclined angle to the side wall 14 of the elevator car and the shaft wall.

In FIG. 3, both the car rope pulley 6 and the counterweight rope pulley 7 are disposed in identical positions so that their middle planes of rotation are parallel to each other and at an angle to the middle plane of rotation of the traction sheave 5. The drive motor 8 is placed in an inclined position so that the middle plane of rotation of the traction sheave 5 is at an angle to the side wall 14 of the elevator car and the shaft wall whereas the middle planes of rotation of the car rope pulley 6 and counterweight rope pulley 7 are parallel to the side wall 14 of the elevator car and the shaft wall.

The invention is not restricted to the examples of its embodiments described above, but many variations are possible within the scope of the inventive idea defined in the claims.

What is claimed is:

1. A traction sheave elevator comprising:

an elevator car suspended on hoisting ropes by a car rope pulley; and car guide rails located on one side of the elevator car for guiding the elevator car, wherein the car rope pulley is mounted on the one side of the elevator car above a bottom of the elevator car.

2. The traction sheave elevator as defined in claim 1, wherein a hoisting machine of the traction sheave elevator is located in the elevator shaft.

3. The traction sheave elevator as defined in claim 1, wherein the car guide rails are disposed in an elevator shaft in a vertical direction, and the elevator car is designed to move along the car guide rails, and further comprising:

counterweight guide rails disposed in the elevator shaft on the same side of the elevator car as the car guide rails;

a counterweight designed to move along the counterweight guide rails;

an upper rope pulley mounted on a fixed top structure in the upper part of the elevator shaft;

a counterweight rope pulley connected to the counterweight;

a drive motor disposed in the elevator shaft to drive one of the rope pulleys; and a rope, whose first end is attached to a fixed top structure in the upper part of the elevator shaft on the same side of the elevator car with the car and counterweight guide rails, from where the rope is passed via the counterweight rope pulley, upper pulley and car rope pulley, and whose second end is attached to a fixed top structure, a second end of the rope being attached to a fixed top structure on the same side of the elevator car as the first end; and bearings rotatably mounting the car rope pulley at the side of the elevator car on the same side of the elevator car as the car and counterweight guide rails.

4. The traction sheave elevator as defined in claim 3, wherein the car guide rails and counterweight guide rails are attached to each other and to a wall of the elevator shaft, disposed in parallel directions relative to each other and side by side so that the counterweight guide rails remain between the wall of the elevator shaft and the car guide rails.

5. The traction sheave elevator as defined in claim 3, wherein the distance between the counterweight guide rails is equal to the distance between the car guide rails.

6. The traction sheave elevator as defined in claim 3, wherein the upper rope pulley is a drive wheel connected to the drive motor; and that the drive motor is mounted on the car guide rails and/or counterweight guide rails.

7. The traction sheave elevator as defined in claim 3, further comprising an L-shaped frame structure attached to the car, extending on the side wall of the elevator car on that side where the car guide rails and counterweight guide rails are located and under the bottom of the elevator car, the car rope pulley and the guide elements acting together with the car guide rails being connected to said frame structure.

8. The traction sheave elevator as defined in claim 7, wherein the car rope pulley is disposed inside a space defined by the elevator car and the frame structure.

9. The traction sheave elevator as defined in claim 3, wherein the car rope pulley is placed in the lower part of the elevator car near its bottom.

10. The traction sheave elevator as defined in claim 3, wherein a vertical tangent to the upper rope pulley is substantially aligned with a vertical tangent to the counterweight rope pulley, the rope portion between these pulleys thus being substantially vertical.

11. The traction sheave elevator as defined in claim 3, wherein a vertical tangent to the upper rope pulley is substantially aligned with a vertical tangent to the car rope pulley, the rope portion between these pulleys thus being substantially vertical.

12. The traction sheave elevator as defined in claim 3, wherein a middle plane of rotation of the counterweight rope pulley is parallel to a middle plane of rotation of the car rope pulley, and a middle plane of rotation of the upper rope pulley is at an angle to the middle planes of rotation of the car rope pulley and counterweight rope pulley.

13. The traction sheave elevator as defined in claim 12, wherein the middle plane of rotation of the car rope pulley is parallel to the side wall of the elevator car.

14. The traction sheave elevator as defined in claim 12, wherein the middle plane of rotation of the car rope pulley is at an angle to the side wall of the elevator car.

15. The traction sheave elevator as defined in claim 3, wherein the drive motor is a permanent magnet synchronous motor and that the upper rope pulley is integrated with the rotor of the motor.

16. The traction sheave elevator as defined in claim 1, wherein the car rope pulley is below a top of the elevator car.

17. A traction sheave elevator comprising:

an elevator car suspended on hoisting ropes by a diverting pulley, an upper rope pulley, and a car rope pulley, wherein the car rope pulley is mounted on a side and above a bottom of the elevator car, and a middle plane of rotation of the upper rope pulley is at an angle to a middle plane of rotation of the car rope pulley.

18. The traction sheave elevator as defined in claim 17, wherein a hoisting machine of the traction sheave elevator is located in the elevator shaft.

19. The traction sheave elevator as defined in claim 17, wherein the car guide rails are disposed in an elevator shaft in a vertical direction, and the elevator car is designed to move along the car guide rails, and further comprising:

counterweight guide rails disposed in the elevator shaft on the same side of the elevator car as the car guide rails;

a counterweight designed to move along counterweight guide rails;

an upper rope pulley mounted on a fixed top structure in the upper part of the elevator shaft;

a car rope pulley connected to the elevator car;

the diverting pulley being a counterweight rope pulley connected to the counterweight;

a drive motor disposed in the elevator shaft to drive one of the rope pulleys; and a rope, whose first end is attached to a fixed top structure in the upper part of the elevator shaft on the same side of the elevator car with the car and counterweight guide rails, from where the rope is passed via the counterweight rope pulley, upper pulley and car rope pulley, and whose second end is attached to a fixed top structure, a second end of the rope being attached to a fixed top structure on the same side of the elevator car as the first end; and bearings rotatably mounting the car rope pulley at the side of the elevator car on the same side of the elevator car as the car and counterweight guide rails.

20. The traction sheave elevator as defined in claim 19, wherein the car guide rails and counterweight guide rails are attached to each other and to a wall of the elevator shaft, disposed in parallel directions relative to each other and side by side so that the counterweight guide rails remain between the wall of the elevator shaft and the car guide rails.

21. The traction sheave elevator as defined in claim 19, wherein the distance between the counterweight guide rails is equal to the distance between the car guide rails.

22. The traction sheave elevator as defined in claim 19, wherein the upper rope pulley is a drive wheel connected to the drive motor; and that the drive motor is mounted on the car guide rails and/or counterweight guide rails.

23. The traction sheave elevator as defined in claim 19, further comprising an L-shaped frame structure attached to the car, extending on the side wall of the elevator car on that side where the car guide rails and counterweight guide rails are located and under the bottom of the elevator car, the car rope pulley and the guide elements acting together with the car guide rails being connected to said frame structure.

24. The traction sheave elevator as defined in claim 23, wherein the car rope pulley is disposed inside a space defined by the elevator car and the frame structure.

25. The traction sheave elevator as defined in claim 19, wherein the car rope pulley is placed in the lower part of the elevator car near its bottom.

26. The traction sheave elevator as defined in claim 19, wherein a vertical tangent to the upper rope pulley is substantially aligned with a vertical tangent to the counterweight rope pulley, the rope portion between these pulleys thus being substantially vertical.

27. The traction sheave elevator as defined in claim 19, wherein a vertical tangent to the upper rope pulley is substantially aligned with a vertical tangent to the car rope pulley, the rope portion between these pulleys thus being substantially vertical.

28. The traction sheave elevator as defined in claim 19, wherein the drive motor is a permanent magnet synchronous motor and that the upper rope pulley is integrated with the rotor of the motor.

29. The traction sheave elevator as defined in claim 17, wherein the car rope pulley is below a top of the elevator car.

30. A traction sheave elevator comprising:

an elevator car suspended on hoisting ropes by a car rope pulley, wherein the car rope pulley is mounted on a side and above a bottom of the elevator car, and a middle plane of rotation of the car rope pulley is at an angle to a side wall of the elevator car.

31. The traction sheave elevator as defined in claim 30, wherein a hoisting machine of the traction sheave elevator is located in the elevator shaft.

32. The traction sheave elevator as defined in claim 30, wherein car guide rails are disposed in an elevator shaft in a vertical direction, and the elevator car is designed to move along the car guide rails, and further comprising:

counterweight guide rails disposed in the elevator shaft on the same side of the elevator car as the car guide rails;

a counterweight designed to move along the counterweight guide rails;

an upper rope pulley mounted on a fixed top structure in the upper part of the elevator shaft;

a counterweight rope pulley connected to the counterweight;

a drive motor disposed in the elevator shaft to drive one of the rope pulleys; and a rope, whose first end is attached to a fixed top structure in the upper part of the elevator shaft on the same side of the elevator car with the car and counterweight guide rails, from where the rope is passed via the counterweight rope pulley, upper pulley and car rope pulley, and whose second end is attached to a fixed top structure, a second end of the rope being attached to a fixed top structure on the same side of the elevator car as the first end; and bearings rotatably mounting the car rope pulley at the side of the elevator car on the same side of the elevator car as the car and counterweight guide rails.

33. The traction sheave elevator as defined in claim 32, wherein the car guide rails and counterweight guide rails are attached to each other and to a wall of the elevator shaft, disposed in parallel directions relative to each other and side by side so that the counterweight guide rails remain between the wall of the elevator shaft and the car guide rails.

34. The traction sheave elevator as defined in claim 32, wherein the distance between the counterweight guide rails is equal to the distance between the car guide rails.

35. The traction sheave elevator as defined in claim 32, wherein the upper rope pulley is a drive wheel connected to the drive motor; and that the drive motor is mounted on the car guide rails and/or counterweight guide rails.

36. The traction sheave elevator as defined in claim 32, further comprising an L-shaped frame structure attached to the car, extending on the side wall of the elevator car on that side where the car guide rails and counterweight guide rails are located and under the bottom of the elevator car, the car rope pulley and the guide elements acting together with the car guide rails being connected to said frame structure.

37. The traction sheave elevator as defined in claim 36, wherein the car rope pulley is disposed inside a space defined by the elevator car and the frame structure.

38. The traction sheave elevator as defined in claim 32, wherein the car rope pulley is placed in the lower part of the elevator car near its bottom.

39. The traction sheave elevator as defined in claim 32, wherein a vertical tangent to the upper rope pulley is substantially aligned with a vertical tangent to the counterweight rope pulley, the rope portion between these pulleys thus being substantially vertical.

40. The traction sheave elevator as defined in claim 32, wherein a vertical tangent to the upper rope pulley is substantially aligned with a vertical tangent to the car rope pulley, the rope portion between these pulleys thus being substantially vertical.

41. The traction sheave elevator as defined in claim 32, wherein the drive motor is a permanent magnet synchronous motor and that the upper rope pulley is integrated with the rotor of the motor.

42. The traction sheave elevator as defined in claim 30, wherein the car rope pulley is below a top of the elevator car.

43. A method for suspending an elevator car, comprising the steps of:

providing car guide rails located on one side of the elevator car for guiding the elevator car; and providing at least one hoisting rope and a car rope pulley for suspending the elevator car suspended on the at least one hoisting rope by the car rope pulley, wherein the car rope pulley is mounted on the one side of the elevator car, a loop opening in an upward direction is formed in the at least one hoisting rope, and the elevator car is suspended in this loop by the car rope pulley.

44. The method for suspending an elevator car as defined in claim 43, further comprising the step of providing the car rope pulley above a bottom of the elevator car.

45. The method of suspending an elevator car as defined in claim 44, further comprising the step of providing the car rope pulley below a top of the elevator car.

46. The method of suspending an elevator car as defined in claim 43, further comprising the steps of:

providing a pair of counterweight guide rails disposed on the same side of the elevator car as the car guide rails; and passing the at least one hoisting rope around a counterweight rope pulley connected to a counterweight movable along the counterweight guide.

* * * * *